US006745576B1

(12) United States Patent
Granger

(10) Patent No.: US 6,745,576 B1
(45) Date of Patent: Jun. 8, 2004

(54) NATURAL GAS VAPOR RECONDENSER SYSTEM

(75) Inventor: Darron Granger, 1007 Honeyhill Dr., Houston, TX (US) 77077

(73) Assignee: Darron Granger, Houston, TX (US)

( * ) Notice: Subject to any disclaimer, the term of this patent is extended or adjusted under 35 U.S.C. 154(b) by 0 days.

(21) Appl. No.: 10/346,798

(22) Filed: Jan. 17, 2003

(51) Int. Cl.[7] ..... F17C 3/10; F25J 1/00
(52) U.S. Cl. ..... 62/48.2; 62/613
(58) Field of Search ..... 62/48.2, 613

(56) References Cited

U.S. PATENT DOCUMENTS

| | | | | | |
|---|---|---|---|---|---|
| 3,733,838 | A | | 5/1973 | Delahunty | |
| 3,857,245 | A | * | 12/1974 | Jones | 60/651 |
| 3,889,485 | A | * | 6/1975 | Swearingen | 62/48.2 |
| 4,054,433 | A | | 10/1977 | Buffiere et al. | |
| 4,110,996 | A | * | 9/1978 | Thompson | 62/48.2 |
| 4,249,387 | A | | 2/1981 | Crowley | |
| 4,846,862 | A | | 7/1989 | Cook | |
| 5,129,599 | A | * | 7/1992 | Wollen | 244/135 R |
| 5,860,294 | A | * | 1/1999 | Brendeng | 62/619 |
| 6,192,705 | B1 | | 2/2001 | Kimble, III | |
| 6,449,983 | B2 | * | 9/2002 | Pozivil | 62/613 |

* cited by examiner

*Primary Examiner*—William C. Doerrler
(74) *Attorney, Agent, or Firm*—Wendy Buskop; Buskop Law Group, P.C.

(57) ABSTRACT

An apparatus for re-liquefying boil-off gas produced by liquid natural gas is described. The apparatus is made up of a collector, wherein the collector contains liquid natural gas, at least one first pump, wherein the first pump is in or adjacent to the liquid natural gas collector, a compressor, wherein the compressor communicates with the liquid natural gas (LNG) collector by a first conduit, at least one mixing device, wherein the mixing device communicates with the compressor by a second conduit, and wherein the mixing device communicates with the first pump by a third conduit, at least one separating device, wherein the separating device communicates with the mixing device by a fourth conduit, and wherein the separating device also communicates with the liquid natural gas (LNG) collector by a fifth conduit.

31 Claims, 2 Drawing Sheets

NATURAL GAS VAPOR RECONDENSER SYSTEM

FIELD OF THE INVENTION

The present invention relates generally to liquid natural gas vaporization and more particularly to the recovery of boil-off gas vapors from n liquefied natural gas (LNG).

BACKGROUND OF THE INVENTION

Natural gas liquefaction by cryogenic cooling is practiced at remote natural gas rich locations to convert the natural gas to a transportable liquid for shipment to available markets. Before and after transport, the liquefied natural gas (LNG) is stored in a storage tank. Evaporation inside the tank causes the LNG to boil off natural gas vapors, which collect in the storage tank. The vapors generated are defined as boil-off vapors and are low-pressure natural gas. These boil-off vapors would eventually cause the tank pressure to rise above its design pressure if not appropriately addressed.

Various procedures exist in the art for dealing with these vapors including venting the vapors into the atmosphere, compressing the vapors to pipeline or process pressure and injecting them into the pipeline or process. These procedures, however, are not environmentally friendly and generally are not economically viable. To avoid these problems, boil-off vapors can be recondensed into the LNG that is being pumped to pipeline pressure (via booster pumps), which in turn is vaporized and injected into the pipeline. Not only is such procedure environmentally friendly and economically viable, but is also efficient because all of the natural gas, including its vapors, is utilized.

Natural gas recondenser systems in the industry typically require complicated internal components for the recondenser (such as pall rings, separator devices, deflector plates, internal piping, etc.). In addition, recondenser systems used in the industry typically require a liquid level to be maintained in the recondenser vessel, which also requires high-pressure make-up gas (pipeline gas or nitrogen) to be injected into the recondenser to force a liquid level in the recondenser. Some of these systems also contain separate heat exchangers, as well &a complex controls, equipment, and valving.

It is desired therefore to have a natural gas recondenser system that recondenses boil-off vapors from a LNG tank via a simplified system with less equipment and less valving. It is also desired to halve a natural gas recondenser system that does not require a liquid level to be maintained in the vapor/liquid separator drum (recondenser) and hence does not require any high-pressure make-up gas. In addition, it is desired to have an efficient natural gas recondenser system that recycles excess vapor back to the LNG tank to have another chance to be recondensed.

SUMMARY OF THE INVENTION

One embodiment of the present invention is a process for re-liquefying boil-off gas produced by liquid natural gas. The process contains the steps of (a) containing liquid natural gas in a collector (LNG storage tank), wherein the liquid natural gas produces boil-off gas, (b) compressing and cooling the boil-off gas, to form a higher pressure vapor stream, (c) boosting the pressure of the liquid natural gas to form pressurized liquid natural gas, (d) combining this cooled vapor stream with the pressurized natural gas in a mixing device, to form a substantially liquid gas stream, (e) separating in a separating device any vapor, if vapor exists, from the substantially liquid gas stream to form a vaporless liquid gas stream, (f) returning any vapor from the separating device to the LNG storage tank, and (g) repeating steps (a) to (f).

Another embodiment of the present invention is an apparatus for re-liquefying boil-off gas produced by liquid natural gas. The apparatus is made up of a collector (LNG storage tank), wherein the LNG storage tank contains liquid natural gas, at least one first pump, wherein the first pump is in or adjacent to the LNG storage tank, a compressor, wherein the compressor communicates with the vapor space in the LNG storage tank by a first conduit, at least one mixing device, wherein the mixing device communicates with the compressor by a second conduit, and wherein the mixing device communicates with the first pump by a third conduit, at least one separating device, wherein the separating device communicates with the mixing device by a fourth conduit, and wherein the separating device also communicates with the vapor space in the LNG storage tank by a fifth conduit.

DETAILED DESCRIPTION

While the making and using of various embodiments of the present invention are discussed in detail below, it should be appreciate d that the present invention provides many applicable inventive concepts that may be err bodied in a wide variety of specific contexts. The specific embodiments discussed herein are merely illustrative of specific ways to make and use the invention and do not limit the scope of the invention.

The present invention includes an apparatus and process for re-liquefying boil-off gas generated from liquid natural gas (LNG). The present invention includes an apparatus and process that eliminates the need for a liquid level to be maintained in the recondenser vessel and similarly, eliminates the need for make-up gas to be injected into the recondenser to force a liquid level in the recondenser. In addition, the present invention provides a simplified vapor/liquid recondenser or separator, and provides a mechanism where excess boil-off vapors and non-condensed vapors may be routed back through the system (recycled back to the LNG storage tank) for another chance to be absorbed in an LNG stream.

Generally, the present invention may be useful for reliquification of boil-off gas vapors from liquid natural gas stored in a saturated liquid state at cryogenic temperatures (generally about −160° C.) and at pressures sufficient for the liquid natural gas to be at or below its bubble point. As used herein the term "bubble point" generally is the temperature and pressure at which a liquid begins to convert to a gas. For example, if a certain volume of liquid natural gas is held at constant pressure, but its temperature is increased, the temperature at which bubbles of gas begin to form in the liquid natural gas is the bubble point. Similarly, if a certain volume of liquid fluid natural gas is held at constant temperature but the pressure is reduced, the pressure at which gas begins to form defines the bubble point. At the bubble point, the liquid natural gas is a saturated liquid. If liquid natural gas is further cooled, this subcooling reduces the amount of boil-off vapors during its storage, transportation and handling. Liquid that does not boil is said to be subcooled.

Nevertheless, heat leakage into the LNG storage tank may cause the LNG to boil off natural gas vapors, which are collected in tile LNG storage tank. These vapors generally may be handled by either venting the vapors into the atmosphere, compressing the vapors to pipeline or process pressure and injecting them into the pipeline or process, recondensing the vapors and placing them back into the LNG storage tank, or recondensing the vapors into the LNG stream that is flowing to booster pumps, which in turn is pumped to pipeline pressure, vaporized and injected into the pipeline. The present invention addresses this last point.

Figure 1:
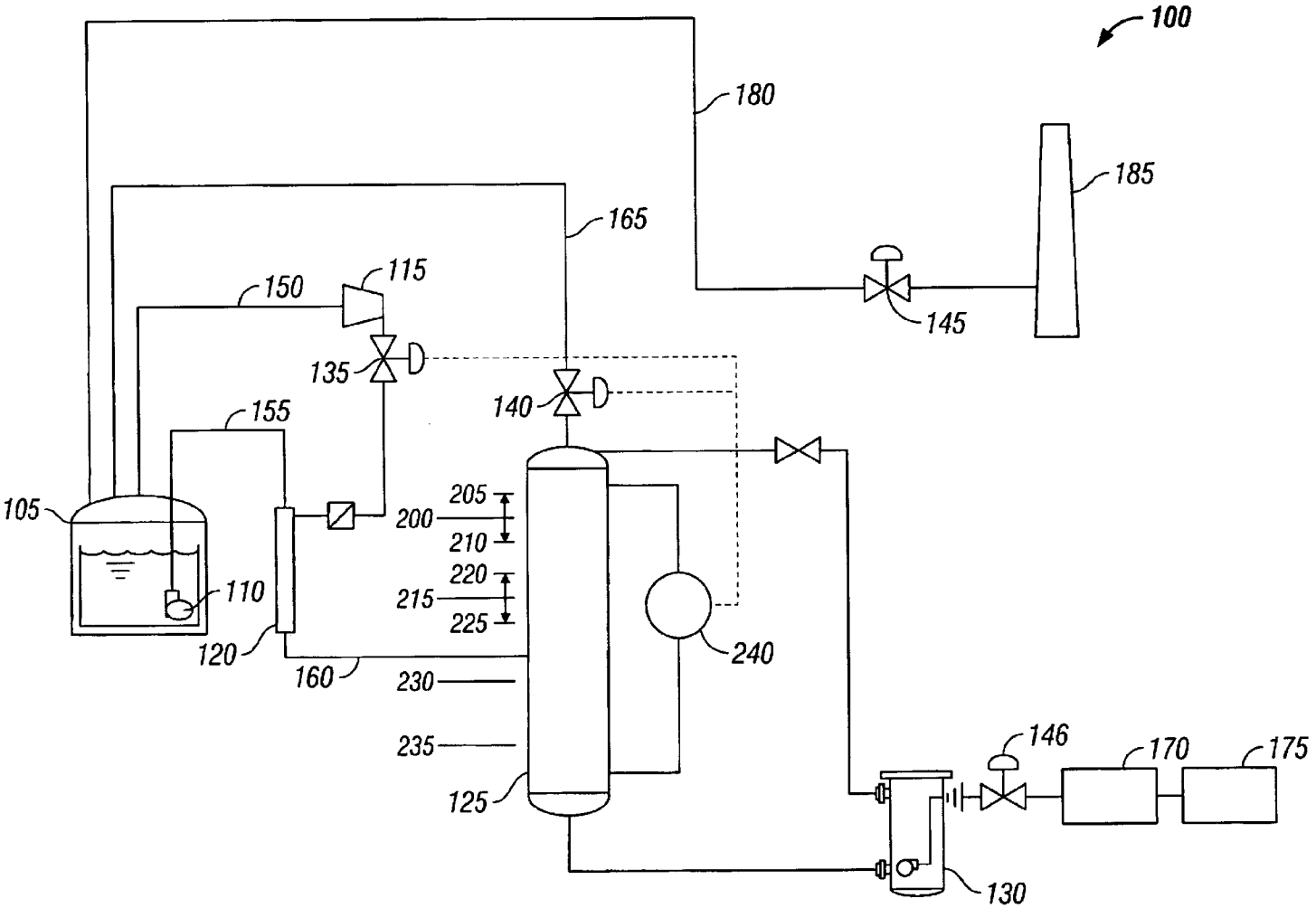
FIG. 1 is a schematical flow diagram of one embodiment of the present invention.

The present invention and its advantages may be described with reference to the flow diagram illustrated in FIG. 1. The overall system is generally indicated at 100. The system contains a collector or liquefied natural gas (LNG) collector (for example an LNG storage tank 105), a vapor compressor 115, a static mixer 120, a separator 125, a secondary pump 130, restrictors (as for example restrictor 135), and interconnecting conduits to be described. Liquefied natural gas (LNG) may be stored in an LNG storage tank 105. LNG in collector or LNG storage tank 105 is generally stored at near atmospheric pressure in a saturated liquid state (boiling) at cryogenic temperatures (about −160° C.). In one embodiment of the present invention, the LNG may be stored at pressures in the range of from about 0 psig to about 250 psig and at temperatures in the range of from about −160° C. to about −130° C. LNG storage tank 105 may be any suitable receptacle for storing LNG or another saturated liquid.

Generally, in order to transport the sub-cooled (low pressure) LNG, the LNG must eventually be pumped to pipeline pressure. In one embodiment of the present invention, the LNG is pumped from LNG storage tank 105 via an "in tank" or primary pump 110. Generally, the primary pump 110 may be any device sufficient to increase the pressure of LNG contained in LNG storage tank 105. Primary pump 110 may be located within LNG storage tank 105 or may be located immediately outside LNG storage tank 105. In one embodiment of the present invention primary pump 110 increases the pressure of the LNG to a pressure in the range of from about 3 to about 10 barg (150 psig) in order to provide the required Net Positive Suction Head (NPSH) for subsequent pumps, such as secondary booster pump 130, which further increases the LNG pressure up to pipeline pressure.

The LNG, after being pumped via primary pump 110, passes through conduit 155 and into static mixer 120. Static mixers are common tools employed in various process facilities and are commercially available from Chemineer, Inc., Kam Controls, Inc., Lightnin Co., as well as others. Generally, static mixer 120 serves to provide intimate contact between the LNG and the boil-off gas vapors (described below). Because the LNG is sub-cooled and is at a sufficient pressure, the LNG has the capacity to absorb a portion (or all) of the natural gas vapors completely back into the liquid state. Any static mixer may be employed in the present invention. Useful examples of static mixers include, but are not limited to, straight pieces of pipe (approximately 20 feet) with internal stationary fan blades welded inside. Generally, the material may be for example stainless steel type 304L or type 316L material suitable for cryogenic temperatures. The ends generally may be raised face weld neck (FRWN) 150# class flanges. In one embodiment of the present invention, the orientation of static mixer 120 is vertical with the LNG and vapor entering from the top. Orientation of the static mixer can be at any angle.

Boil-off gas vapors present in LNG storage tank 105 are passed through conduit 150 and into vapor compressor 115 where the vapors are compressed. Vapor compressor 115 may be any compressor known in the art. Particularly useful vapor compressors include, but are not limited to, boil-of gas compressors. After the vapors are compressed, the vapors pass through restrictor 135 (control valve) and then are injected into static mixer 120. The internal blades of static mixer 120 make tiny bubbles out of the incoming boil-off vapor (which increases its surface area) and then mixes them in the main LNG, flowing from primary pump 110 in conduit 155. The main LNG flow absorbs most or all the tiny bubbles of natural gas and then flows into conduit 160. The restrictor 140 can be in the open or closed position, or in a partially open or partially closed position. In the most preferred embodiment, the restrictor or valve is in the partially open/partially closed position.

In one embodiment of the present invention, restrictor 135 is a pinch or control valve. Generally, restrictor 135 remains in an open position, thus allowing vapors that have been collected in LNG storage tank 105 to pass through restrictor 135 and into static mixer 120. As will be more fully described below, restrictor 135 may progressively move to a closed position, depending on the level contained in separator 125, also described below. Boil-off gas vapors present in LNG storage tank 105 are passed through conduit 150 and into vapor compressor 115 where the vapors are compressed. Vapor compressor 115 may be any compressor known in the art. Particularly useful vapor compressors include, but are not limited to, boil-off gas compressors. After the vapors are compressed, the vapors pass through restrictor 135 and then are injected into static mixer 120. The internal blades of static mixer 120 make tiny bubbles out of the incoming boil-off vapor (which increases its surface area) an then mixes them in the main LNG, flowing from primary pump 110 in conduit 155. The main LNG flow absorbs the tiny bubbles of natural gas.

Boil-off gas vapors injected into static mixer 120 may be absorbed by the LNG flowing from primary pump 110 in conduit 155 and preferably are converted back to a liquid state. Occasionally, all of the boil-off gas vapor are not absorbed into the LNG. This may be due to a number of factors such as too much vapor flow, too low LNG flow, or non-condensable vapors present in the boil-off gas vapors. Because subsequent pumps (such as secondary booster pump 130) may be designed to operate with zero vapor (bubbles) in the LNG, all vapors generally must be removed before the LNG reaches secondary booster pump 130.

To remove these non-condensed vapor before they reach secondary booster pump 130, the LNG must be directed through a vapor/liquid separator drum ("separator") 125. After the LNG and boil-off gas vapors are mixed in static mixer 120, the LNG stream and optionally a LNG/LNG vapor stream is passed through conduit 160, and into separator 125.

Separator 125 may be any device that is capable of containing a liquid and providing means in which vapors, if present, may be separated from the liquid. Generally, separating devices useful in the present invention include drum shaped containers, although any shaped container may be used. After the LNG stream, and optionally a LNG/LNG vapor stream, enters separator 125, the liquid fills separator 125 from the bottom to the top. Generally, separator 125 provides a forum where vapors are allowed to separate from the liquid and float to the top of separator 125. These LNG vapors in separator 125 are vented back to storage tank 105 where they again enter the cycle and may be recondensed in the LNG stream. According to one embodiment of the present invention, these vapors pass from separator 125 through conduit 165 passing through restrictor 140 and then back into LNG storage tank 105. At this point, the vapors are allowed to proceed through the recondensing process again. In one embodiment of the present invention, restrictor 140 is a control valve.

Generally, restrictor 140 remains in the closed position when separator 125 contains mostly liquid. If separator 125 contains vapor, restrictor 140 opens to allow the non-condensed vapors to be directed back to LNG storage tank 105 via conduit 165 to be recycled back through static mixer 120.

After the LNG or LNG/LNG vapor passes through separator 125, the LNG portion passes from the bottom of separator 125 directly to secondary booster pump 130 (without entrapped vapors). From secondary booster pump 130, the LNG stream passes through restrictor 146 and flows through vaporizer 170. One function of vaporizer 170 is to vaporize and heat the LNG to a temperature compatible with requirements of receiver 175. From vaporizer 170, the LNG is conveyed to receiver 175. Examples of useful receivers include, but are not limited to, a pipeline, the inlet of a gas turbine, the inlet of a chemical process, a compressor inlet, a burner inlet and the like. In one embodiment of the present invention, the receiver is a pipeline.

In one embodiment of the present invention, separator 125 may be divided into multiple levels to provide a convenient way to measure the amount of liquid contained in separator 125. Although an infinite number of levels may be designated, separator 125 generally has from between 2 to 4 levels. In one embodiment of the present invention, separator 125 contains four levels. In addition, at each level, separator 125 may contain means for monitoring or sensing the level of liquid contained in separator 125. Useful means for monitoring the level of liquid contained in separator 125 include, but are not limited to, level indicating controllers, level transmitters and the like. Level transmitters/controllers are common tools employed in all types of process facilities. A level transmitter is a device that is contained in a vessel and sends a signal, the strength of which is proportional to the level it senses. A level controller receives this signal and then opens or closes a valve per programmed instructions based on the level signal received. Level transmitters/controllers are known in the art (for example, those commercially, available from American Magnetics, Inc.) In FIG. 1, a level indicating controller ("LIC") is indicated at 240. The level transmitter plugs into a panel on or near separator 125. LIC 240 generally contains a "split range" controller, which means that more than one valve may be controlled based on the level signal received.

Figure 2:
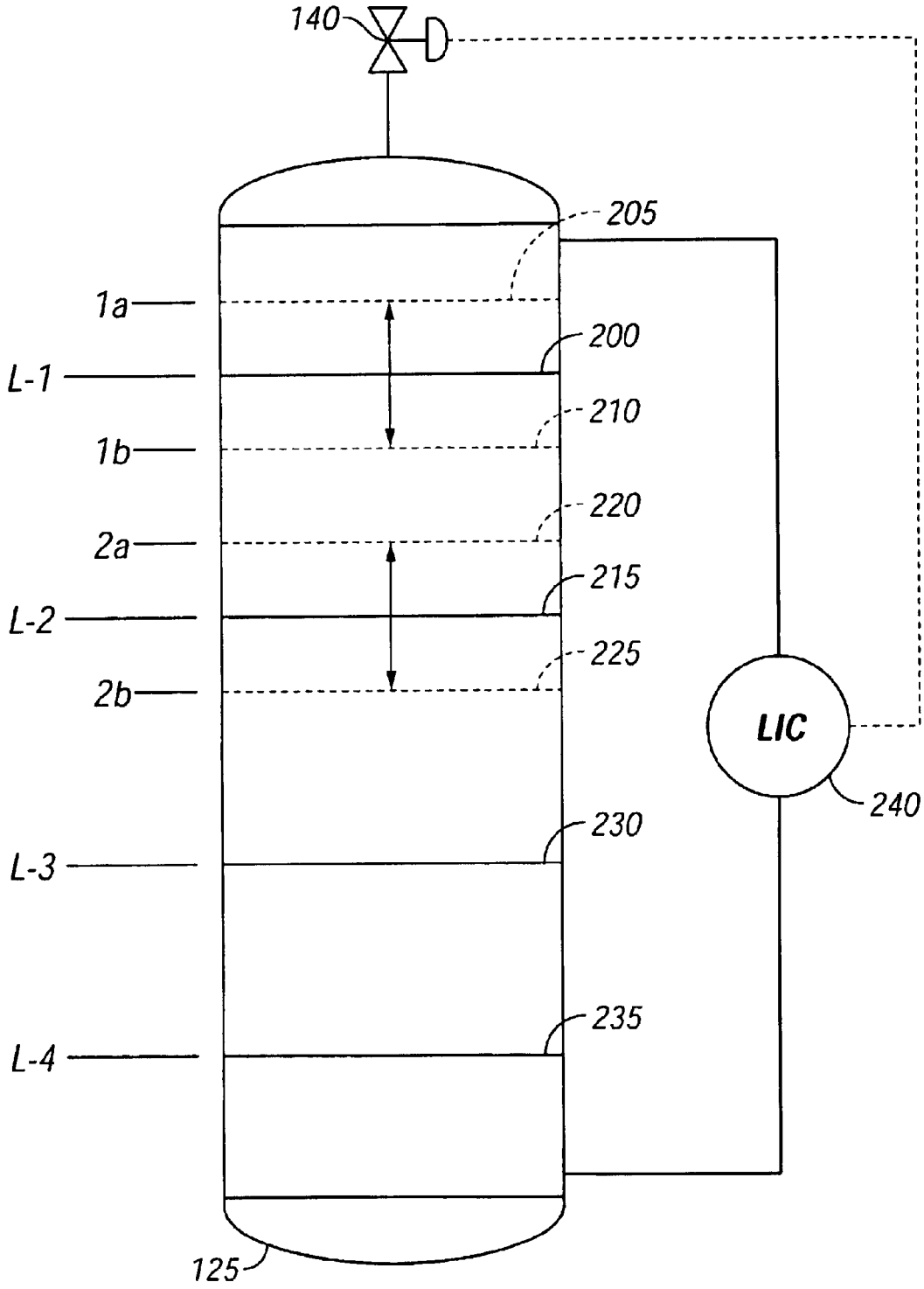
FIG. 2 is a diagram of a liquid/vapor separator drum according to one embodiment of the present invention.

FIG. 2 is a diagram illustrating various level measurements in separator 125 according to one embodiment of the present invention. As shown in FIG. 2, separator 125 contains 4 levels: LEVEL 1 (L1) shown at line 200 between level 1*a* at line 205 and level 1*b* at line 210, LEVEL 2 (L2) shown at line 215 between level 2*a* at line 220(and level 2*b* at line 225, LEVEL 3 (L3) shown at line 230, and LEVEL 4 (L4) shown at line 235.

In the present invention, separator 125 may operate completely full of LNG or may operate partially full. If separator 125 is partially full of LNG, and that level is anywhere above level 1*a* (at line 205) restrictor 140 remains in its normally closed position. As the level of liquid LNG drops below level 1*a* (at line 205), a level controller signals restrictor 140 to open slightly to allow non-condensed vapors back to LNG storage tank 105. As the liquid level drops to level 1*b* (line 210), restrictor 140 is allowed to progressively open to its maximum opening.

Similarly, if more vapors enter separator, 125 causing the level to drop to level 2*a* (line 220), a level controller signals restrictor 135 to slightly close. As described above, restrictor 135, which may for example be a valve, is generally located in conduit 150 between vapor compressor 115 and static mixer 120. This action causes fewer vapors to be injected into static mixer 120. As the level drops below level 2*a* (line 220), a level controller signals restrictor 135 to progressively close and may be fully closed, for example, at level 2*b* (line 225), or whatever level or position the operator chooses. This action completely stops additional vapors from entering static mixer 120. In a zero vapor flow case, the compressor will automatically unload itself if it is a reciprocating compressor or go on automatic bypass if it is a centrifugal or rotating compressor.

Level 3 (L3) (at line 230) may be described as a position below L2 and L1 where, should the LNG drop to this level, a level controller may cause an alarm to sound thus alerting the operator that low levels exist in separator 125. In another embodiment of the present invention, no alarm is activated at L3. In one embodiment of the present invention, level 4 (L4) (at line 235) is a position below L3, L2 aid L1, where, should the LNG drop to this level or below, a level controller causes a shutdown of secondary booster pump 130 so as to protect the pump from damage due to cavitation. According to one embodiment of the present invention, separator 125 contains no liquid.

In another embodiment of the present invention, should non-condensable vapors accumulate in LNG storage tank 105 causing high-pressures, a tank pressure controller may signal restrictor 145 to open. This action would allow the non-condensable rich vapor to vent in the atmosphere or other safe location.

It should be understood that the conditions of temperature and pressure set forth herein are dependent on efficient system components, which are assumed. In addition, these conditions may change depending on the temperature and pressure of the LNG, the nature of receiver 175, efficiency of the equipment (for example, vapor compressor 115, static mixer 120 and separator 125), and other factors. FIG. 1 also shows element 185, which can be a flare connected to conduit 180, which communicates with the tank or collector 105. In an alternative embodiment, the flare 185 could be a vent 185 also in communication with the collector 105, which could be a tank.

What is claimed is:

1. An apparatus for re-liquefying boil-off gas produced by liquid natural gas comprising:

a. a collector, wherein the collector contains at least some liquid natural gas;

b. a first pump, wherein the first pump is in or adjacent to the liquid natural gas collector;

c. a compressor, wherein the compressor communicates with the liquid natural gas (LNG) collector by a first conduit;

d. a mixing device, wherein the mixing device communicates with the compressor by a second conduit, and wherein the mixing device communicates with the first pump by a third conduit;

e. a separating device, wherein the separating device communicates with the mixing device by a fourth conduit, and wherein the separating device also communicates with the liquid natural gas (LNG) collector by a fifth conduit; and f. a second pump wherein the second pump communicates with the separating device by a sixth conduit.

2. The apparatus of claim 1, further comprising a receiver, wherein the receiver communicates with the second pump.

3. The apparatus of claim 2, wherein the receiver is selected from the group consisting of a gas turbine, the inlet of a chemical process, a pump inlet, a burner head, and a pipeline.

4. The apparatus of claim 2, wherein the receiver is a pipeline.

5. An apparatus for re-liquefying boil-off gas (bop) produced by liquid natural gas comprising:

a. a collector, wherein the collector contains at least some liquid natural gas;

b. a first pump, wherein the first pump is in or adjacent to the liquid natural gas collector;

c. a compressor, wherein the compressor communicates with the liquid natural gas (LNG) collector by a first conduit;

d. a mixing device, wherein the mixing device communicates with the compressor by a second conduit, and wherein the mixing device communicates with the first pump by a third conduit;

e. a separating device, wherein the separating device communicates with the mixing device by a fourth conduit, and wherein the separating device also communicates with the liquid natural gas (LNG) collector by a fifth conduit;

f. a second pump, wherein the second pump communicates with the separating device by a sixth conduit;

g. a first restrictor, wherein the first restrictor is contained within the fifth conduit, and a second restrictor, wherein the second restrictor is contained within the second conduit; and h. a receiver, wherein the receiver communicates with the second pump.

6. The apparatus of claim 5, wherein the first restrictor is a pinch valve.

7. The apparatus of claim 5, wherein the second restrictor is a control valve.

8. The apparatus of claim 1, wherein the collector is a liquid natural gas (LNG) collector.

9. The apparatus of claim 1, wherein the collector is a tank.

10. The apparatus of claim 1, wherein the compressor is a boil-off gas compressor.

11. The apparatus of claim 1, wherein the mixing device is a static mixer.

12. The apparatus of claim 1, wherein the mixing device provides contact between a LNG boil-off gas vapor stream and an LNG stream.

13. The apparatus of claim 1, wherein the mixing device is oriented in a vertical position.

14. The apparatus of claim 1, wherein the separating device comprises a drum.

15. The apparatus of claim 5 wherein the separating device contains multiple levels.

16. The apparatus of claim 1, wherein the separating device does not require a level to be maintained therein.

17. A process for re-liquefying boil-off gas produced by liquid natural gas comprising the steps of:

a. containing liquid natural gas in a collector, wherein the liquid natural gas produces boil-off gas;

b. compressing and cooling the boil-off gas, to form a higher pressure vapor stream;

c. boosting the pressure of the liquid natural gas to form pressurized liquid natural gas;

d. combining the cooled vapor stream with the pressurized natural gas in a mixing device, to form a substantially liquid gas stream;

e. separating in a separating device any vapor, if vapor exists, from the substantially liquid gas stream to form a vaporless liquid gas stream;

f. returning any vapor from the separating device to the collector; and g. repeating steps (a)–(f).

18. The process of claim 17, further comprising the step of;

h. conveying the vaporless liquid gas stream to a receiver.

19. The process of claim 18, wherein the receiver is selected from the group consisting of a gas turbine, the inlet of a chemical process, a pump inlet, a burner head, and a pipeline.

20. The process of claim 18, wherein the receiver is a pipeline.

21. The process of claim 17, wherein the collector is a liquid natural gas tank.

22. The process of claim 17, wherein the compressing and cooling step is conducted by using a vapor compressor.

23. The process of claim 17, wherein the mixing device is oriented in a vertical, position.

24. The process of claim 17, wherein the mixing device is a static mixer.

25. The process of claim 17, wherein the separating device operates with or without a liquid level therein.

26. A process for re-liquefying boil-off gas produced by liquid natural gas comprising the steps of:

a. containing liquid natural gas in a collector, wherein the liquid natural gas produces boil-off gas, b. compressing and cooling the boil-off gas, to form a higher pressure vapor stream, c. boosting the pressure of the liquid natural gas to form pressurized liquid natural gas, d. combining the cooled vapor stream with the pressurized natural gas in a mixing device, to form a substantially liquid gas stream, e. separating in a separating device any vapor, if vapor exists, from the substantially liquid gas stream to form a vaporless liquid gas stream, f. returning any vapor from the separating device to the collector, g. repeating steps (a)–(f), and h. wherein the combining step comprises passing the cooled vapor stream through a conduit containing a first restrictor, before the cooled vapor stream is combined with the pressurized liquid natural gas.

27. The process of claim 26, wherein the restrictor is a pinch valve.

28. The process of claim 26, wherein the returning step comprises passing any vapor through a conduit containing a second restrictor, before any vapor is returned to the collector.

29. The process of claim 28, wherein the second restrictor is a valve.

30. The process of claim 26, wherein the first restrictor progresses from a closed position to an open position as the level of liquid in the separating device drops from a first position in the separating device to a second position in the separating device, wherein the second position is lower than the first position.

31. The process of claim 28, wherein the second restrictor progresses from an open position to a closed position as the level of liquid in the separating device drops from a second position in the separating device to a third position in the separating device, wherein the third position is lower than the second position.

* * * * *